US007302721B1

(12) United States Patent
Dorr

(10) Patent No.: US 7,302,721 B1
(45) Date of Patent: Dec. 4, 2007

(54) PLEATED BED SHEETS PROVIDING MORE ROOM FOR THE LEGS AND FEET OF A USER

(76) Inventor: Sandy Dorr, 1078 Breyman, Tipton, MI (US) 49287

( * ) Notice: Subject to any disclaimer, the term of this patent is extended or adjusted under 35 U.S.C. 154(b) by 0 days.

(21) Appl. No.: 11/445,436

(22) Filed: Jun. 1, 2006

(51) Int. Cl.
*A47G 9/02* (2006.01)

(52) U.S. Cl. ..... 5/497; 5/485

(58) Field of Classification Search ..... 5/495, 5/497, 499, 485, 482, 493
See application file for complete search history.

(56) References Cited

U.S. PATENT DOCUMENTS

| | | | | | |
|---|---|---|---|---|---|
| 768,119 | A | | 8/1904 | Fine | |
| 2,177,679 | A | * | 10/1939 | Weisbender | 5/485 |
| 2,577,178 | A | * | 12/1951 | Bellinger | 5/485 |
| 2,679,056 | A | * | 5/1954 | Simpson | 5/485 |
| 2,695,414 | A | * | 11/1954 | Ford et al. | 5/485 |
| 2,772,425 | A | * | 12/1956 | Brodie | 5/485 |
| 4,308,626 | A | | 1/1982 | Weiss | |
| 4,964,184 | A | * | 10/1990 | Lewis | 5/496 |
| 5,027,460 | A | * | 7/1991 | Honig | 5/497 |
| 5,042,098 | A | | 8/1991 | Stultz | |
| 5,084,929 | A | * | 2/1992 | Staudinger | 5/494 |
| 5,165,128 | A | * | 11/1992 | Honig | 5/497 |
| 5,189,744 | A | | 3/1993 | Roberts | |
| 5,621,931 | A | * | 4/1997 | Hamilton | 5/493 |
| 5,884,349 | A | * | 3/1999 | Gretsinger | 5/502 |
| 5,970,543 | A | * | 10/1999 | Barreca et al. | 5/497 |
| 6,041,456 | A | | 3/2000 | Pharr | |
| 6,341,396 | B1 | | 1/2002 | Carapezza | |
| 6,532,608 | B2 | | 3/2003 | Schreiner et al. | |
| 6,968,582 | B1 | | 11/2005 | Barton et al. | |
| 2001/0032361 | A1 | * | 10/2001 | Schreiner | 5/497 |

* cited by examiner

*Primary Examiner*—Robert G. Santos
(74) *Attorney, Agent, or Firm*—Gifford, Krass, Sprinkle, Anderson & Citkowski, PC

(57) ABSTRACT

A top sheet for use with a bed having a mattress with a head section, a foot section, a width and a thickness provides enhanced leg/foot room. The various embodiments include a flexible sheet of material having a width with a centerline, a length with a top edge and a bottom edge, and one or more pleats extending up from the bottom edge, each pleat having a length at least equal to the thickness of the mattress plus a few inches for tucking purposes. With such a construction, when the bed is made, the material puffs out around the foot section, thereby providing additional space for the legs and feet of a user. The preferred embodiment comprises a plurality of spaced-apart pleats, each extending up from the bottom edge and substantially perpendicular thereto. A pleat may be provided at or near the centerline, depending upon use in conjunction with single, twin, full, double, queen or king sizes. Each pleat may a length in the range of 6 to 24 inches and a width in the range of 1 to 6 inches, though the invention is not limited in this regard. Nor is the invention limited in terms of the pleats used, which may be knife, box, double-box, and so forth. The edges are optionally stitched down for a neater appearance.

9 Claims, 6 Drawing Sheets

PLEATED BED SHEETS PROVIDING MORE ROOM FOR THE LEGS AND FEET OF A USER

FIELD OF THE INVENTION

This invention relates generally to bedding and, in particular, to pleated sheets providing more room for the legs and feet of a user.

BACKGROUND OF THE INVENTION

In making a bed, the top sheet is conventionally tucked in tightly between the bottom of the mattress and the top of the box spring, providing a clean and wrinkle-free look. However, this leaves no room for the legs or feet of the person(s) using the bed.

The typical prior-art situation is illustrated in FIG. 1, wherein a top sheet 102 is tucked in at areas 110 between the mattress 104 and box spring 106. As shown in the cross-section of FIG. 2, this situation results in very little volume 200 when the bed is typically made, providing little or no room for the legs or feet 210 of a user.

While there do exist proposed solutions to this problem, they tend to be overly complicated and/or expensive to manufacture. According to U.S. Pat. No. 4,308,626, a fitted top sheet includes a construction which provides a foot accommodating space when placed in position on a mattress. The sheet has a one piece construction wherein the fitted bottom corners and foot accommodating space are formed by sewing the cut edges of two cut-outs in each side of a generally rectangular piece of material.

U.S. Pat. No. 5,042,098 is directed to a fitted top sheet with a pleat across the foot end thereof to provide room for a user's feet when placed on a mattress. The fitted sheet is of one piece construction with the space being provided by cutting a generally square section out of two adjacent corners at a narrow end of a generally rectangular sheet, folding a portion of the sheet toward the cut edges on the longer side of the sheet parallel thereto, folding the cut edges at each corner and the adjoining folded edges at right angles to the main sheet surface into overlapping contact with each other at each corner, securing the cut edges and folds of the longer sheet side with the cut edge of the sheet end on each corner by sewing or similar means, seaming the end of the fold spaced away from the cut edge along the side surface of the sheet at right angles to the long edge of the sheet, and placing an elastic material along the outer edge of the folded end and extending along each of the side edges to the seam at the fold spaced apart from the cut edge to form a fitted end when placed around a mattress.

According to U.S. Pat. No. 6,532,608, a fitted top sheet for a bed has pockets for receiving a mattress at a toe end of the sheet, and a transverse pleat or flap at the toe end for accommodating the user's feet. The pleat and the mattress pocket are formed form a single notch cut into each corner of the toe end of the sheet, with the opposed sides of each notch joined together with a single seam extending the length of the notch. The seam may be formed from a line of stitching of a contrasting color from the sheet body, to form a visual indicator to readily identify the upper or lower sides of the sheet. The sheet is fabricated by a method of cutting a notch into the two lower toe corners of the sheet, with the notch having an interior, relatively steep region, merging with a peripheral relatively shallow region.

Other proposed solutions involve the use of pockets or partial pockets. U.S. Pat. No. 6,041,456 discloses a fitted top sheet adapted for use on a mattress having a given width, a given length and a given thickness, the sheet having a width greater then the given mattress width, parallel side edges and a bottom edge, the sheet including an upper portion and a lower portion folded beneath the upper portion, the edges of the lower portion being non-elastically sewn to the side edges of the upper portion to form a pocket, and the bottom edge of the sheet being elastically gathered to a width approximately equal to the given mattress width when in an unstretched condition.

Despite these articles the need remains for a fitted top sheet that provides enhanced leg and foot room while, at the same time, is easily manufactured and esthetically visually pleasing.

SUMMARY OF THE INVENTION

This invention generally resides in a top sheet for use with a bed having a mattress with a head section, a foot section, a width and a thickness. The various embodiments include a flexible sheet of material having a width with a centerline, a length with a top edge and a bottom edge, and one or more pleats extending up from the bottom edge, each pleat having a length at least equal to the thickness of the mattress plus a few inches for tucking purposes. With such a construction, when the bed is made, the material puffs out around the foot section, thereby providing additional space for the legs and feet of a user.

The preferred embodiment comprises a plurality of spaced-apart pleats, each extending up from the bottom edge and substantially perpendicular thereto. A pleat may be provided at or near the centerline, depending upon use in conjunction with single, twin, full, double, queen or king sizes. Each pleat may a length in the range of 6 to 24 inches and a width in the range of 1 to 6 inches, though the invention is not limited in this regard. Nor is the invention limited in terms of the pleats used, which may be knife, box, double-box, and so forth. The edges are optionally stitched down for a neater appearance. The material is woven or non-woven cotton, satin, silk, linen, polyester, microfiber, or some combination thereof.

BRIEF DESCRIPTION OF THE DRAWINGS

FIG. 1 is an oblique perspective drawing of a prior-art mattress and box spring showing the way in which a top sheet is generally tucked in;

DETAILED DESCRIPTION OF THE INVENTION

Figure 1:
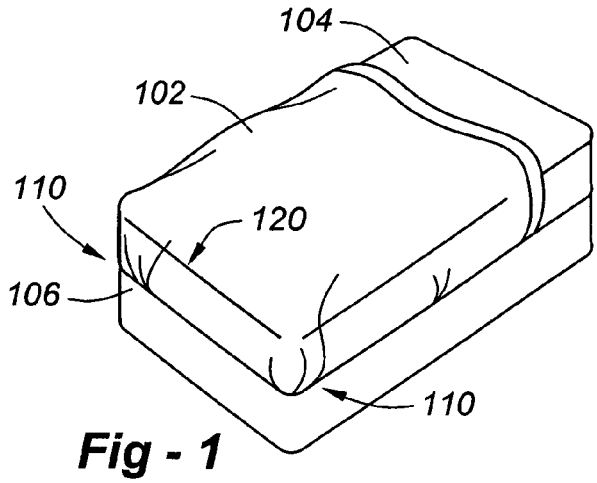
Fig - 1 (PRIOR ART)
Figure 2:
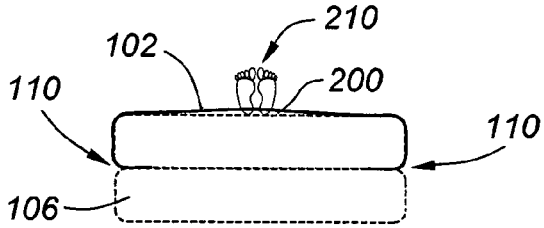
Fig - 2 (PRIOR ART)
FIG. 2 is a cross-sectional view of a situation of FIG. 1.
Figure 3:
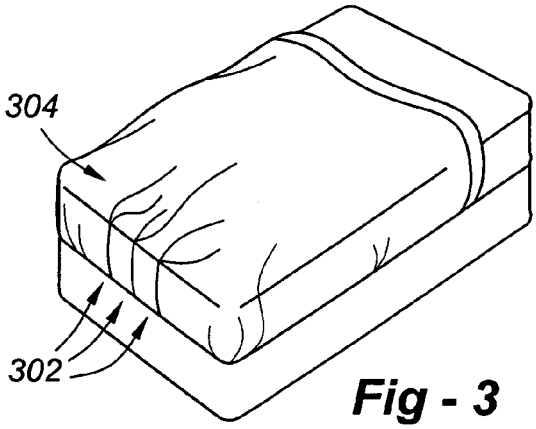
FIG. 3 is an oblique drawing of a typical top sheet constructed in accordance with this invention.
Figure 4:
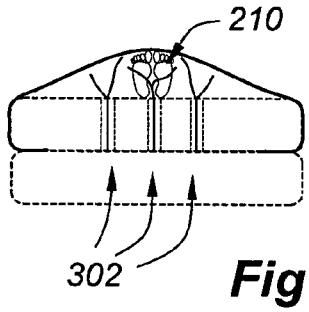
FIG. 4 is an end view of the top sheet of FIG. 3.

Having discussed the problems associated with the prior art in conjunction with FIGS. 1 and 2, the reader's attention is now directed to FIG. 3, which illustrates in broad and general terms the way in which top sheets are constructed in accordance with the invention. As shown in the figure, a plurality of pleats 302 are made at the foot end of the sheet, resulting in an area that puffs out, providing additional volume for the feet and legs of a user. This has been illustrated in FIG. 4, which shows the bottom edge of a bed with a top sheet having three pleats 302, providing ample room for the feet 210 of a person under the sheet.

Figure 5:
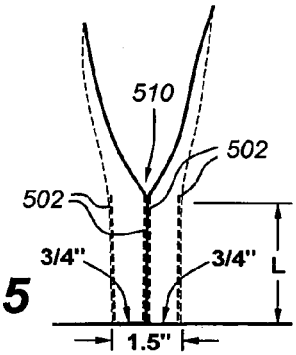
FIG. 5 is a detailed drawing of a typical pleat used according to the invention.

FIG. 5 is a detailed drawing of a typical pleat used according to the invention. The pleat shown is a so-called "box" pleat, shown in simple form in FIG. 6A, wherein two edges of the material used are brought together toward a central line. As used herein, a "three inch pleat" overlaps three quarters of an inch of material on either side, resulting in the use of three inches of material to form the pleat. Preferably, stitches 502 are made at the outside edges of the pleat and where the two edges of the material approach one another, for a cleaner look. These stitches are shown at 502. The length, L, may vary according to the invention, depending upon the thickness of the mattress. Since mattress thickness varies in the range of 6 inches to 14 inches, or perhaps more, the length, L, may be varied accordingly, so that the end of the pleat, indicated at 510 in FIG. 5, is proximate to the bottom edge of the mattress, indicated at 120 in FIG. 1. Although this is not necessary according to the invention, it provides the most beneficial tradeoff between a clean look and ample room for the legs and feet.

Figure 6A:
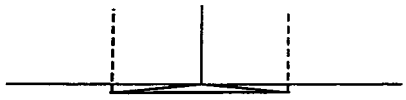
FIG. 6A is a drawing of a box pleat applicable to the invention.
Figure 6B:
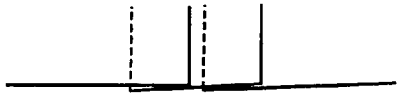
FIG. 6B is a drawing of a knife pleat applicable to the invention.
Figure 6C:
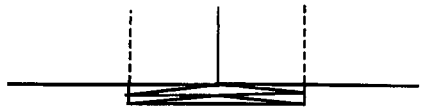
FIG. 6C is a drawing of a double-box pleat applicable to the invention.

As just discussed, the preferred pleat is the box pleat shown in FIG. 6A, though the invention is not limited in this regard either. Alternatively, knife pleats, as shown in FIG. 6B, may be used, as well as double box pleats shown in FIG. 6C. Nowhere is the invention limited in terms of the type of sheet material used, insofar as cotton, linen, silk, satin, microfiber, synthetic/polyester or combinations thereof may be utilized.

Figure 7:
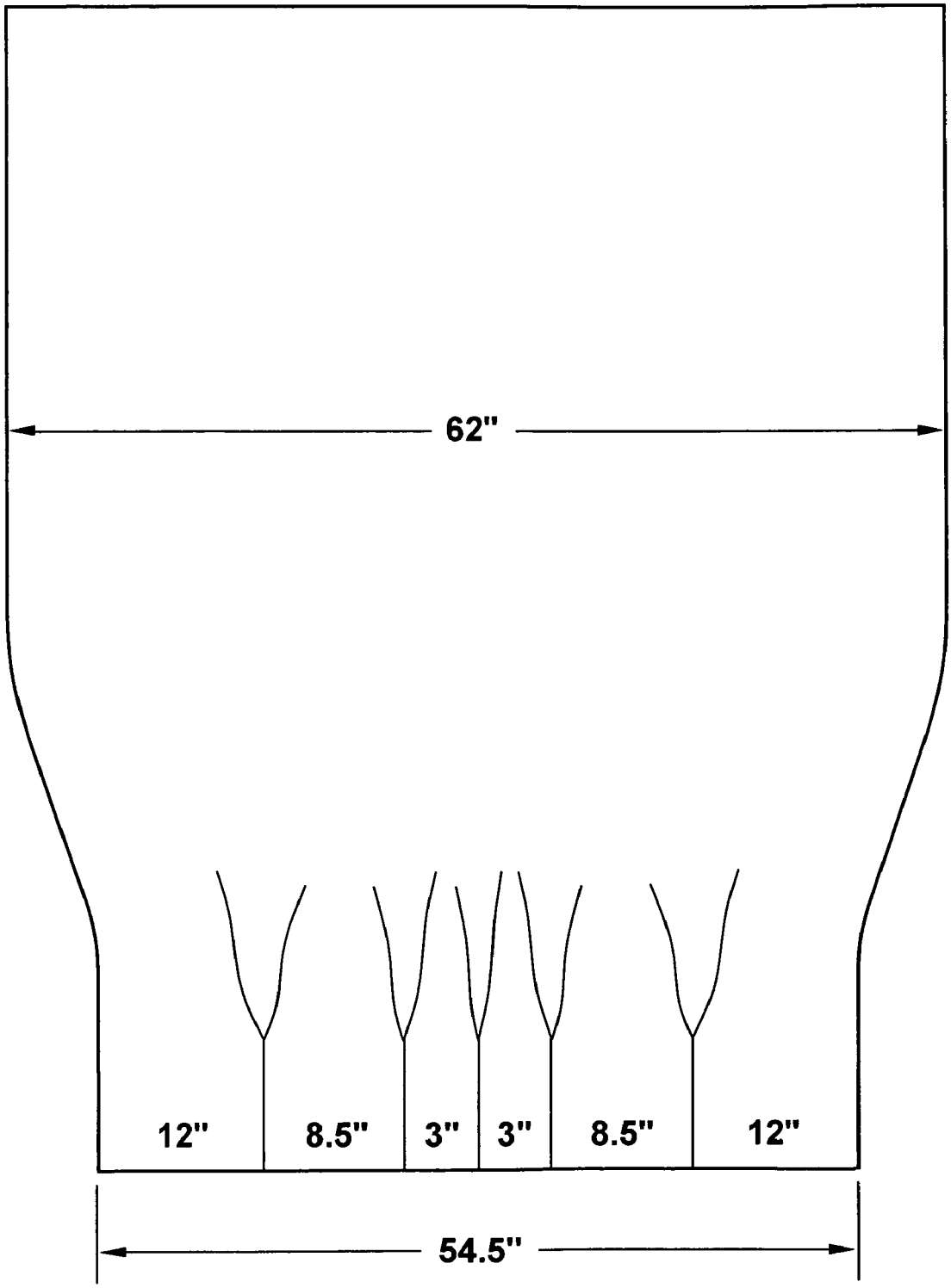
FIG. 7 is a drawing of a preferred embodiment applicable to a top sheet for a twin bed.

FIG. 7 is a detailed drawing showing the way in which a sheet may be configured according to the invention for use with a twin bed. In this case, there is a central three-inch pleat, with three inches of material on either side. The other pleats are also three-inch pleats, with the distances between the pleats being indicated at 8.5 inches and 12 inches (to the outside edges). This results in a width of 54.5 inches at the foot end of the sheet, and since a typical twin sheet is 62 inches in width, the bottom edge of the sheet is slightly narrower than full width. However, since twin mattresses tend to have small width, this still allows sufficient material for a tuck of four inches or greater, even at the foot of the bed.

Figure 8:
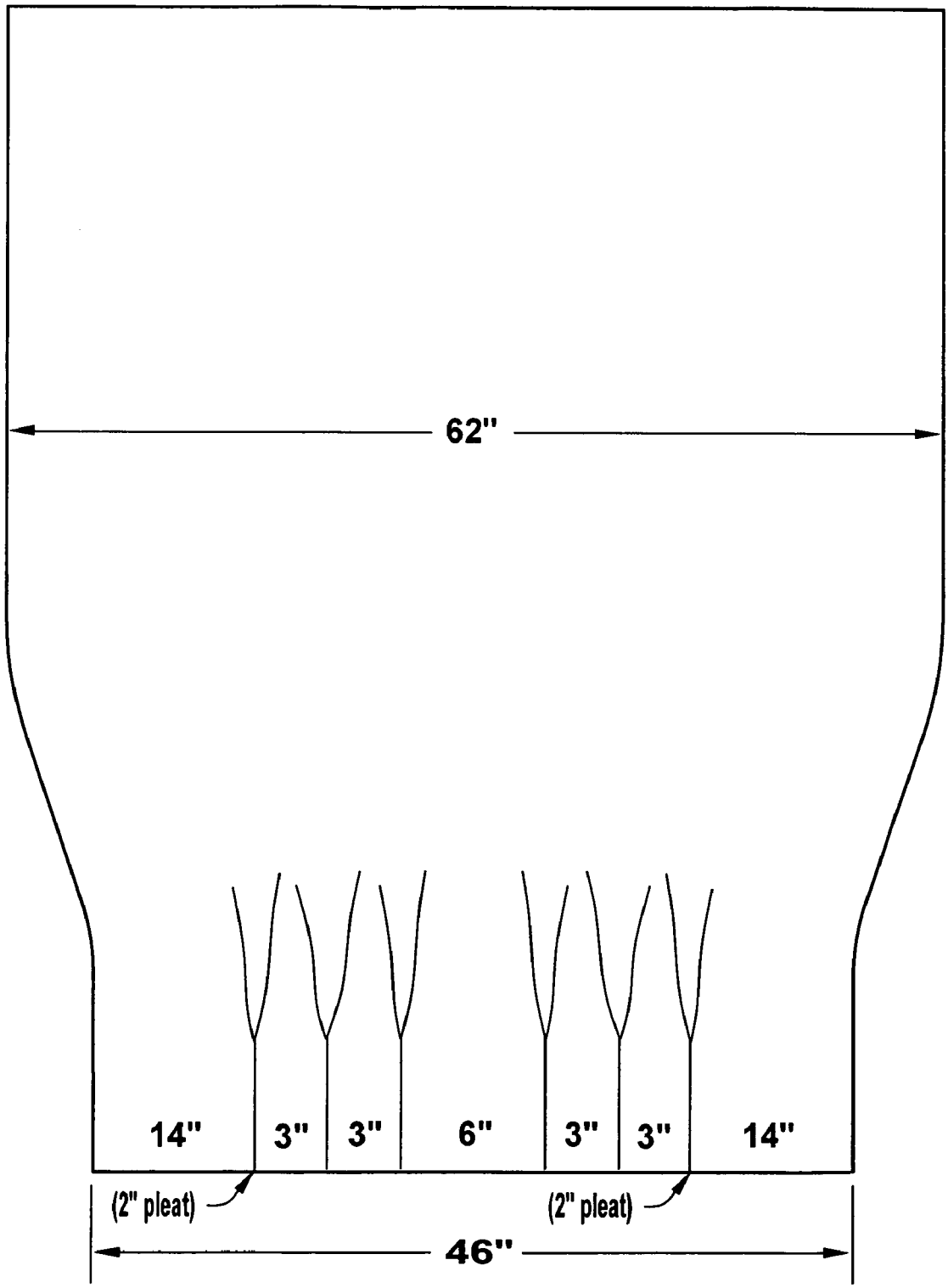
FIG. 8 is a drawing of an alternative configuration for a sheet to twin bed.

FIG. 8 is a detail drawing of an alternative configuration for a twin bed, wherein a six inch width of material is substituted in the center of the sheet, and two inch pleats are used on the outer edges, as shown. Although FIGS. 7 and 8 and the subsequent figures for larger size beds show preferred pleating arrangements according to the invention, it will be appreciated by those of skill in the art that the invention is not limited to the exact number or widths of pleats in each case. Rather, so long as a plurality of longitudinal pleats are provided from the bottom edge of the sheet upwardly at a distance on the order of 10 inches or more, such a configuration would be considered to be within the spirit and scope of this invention.

Figure 9:
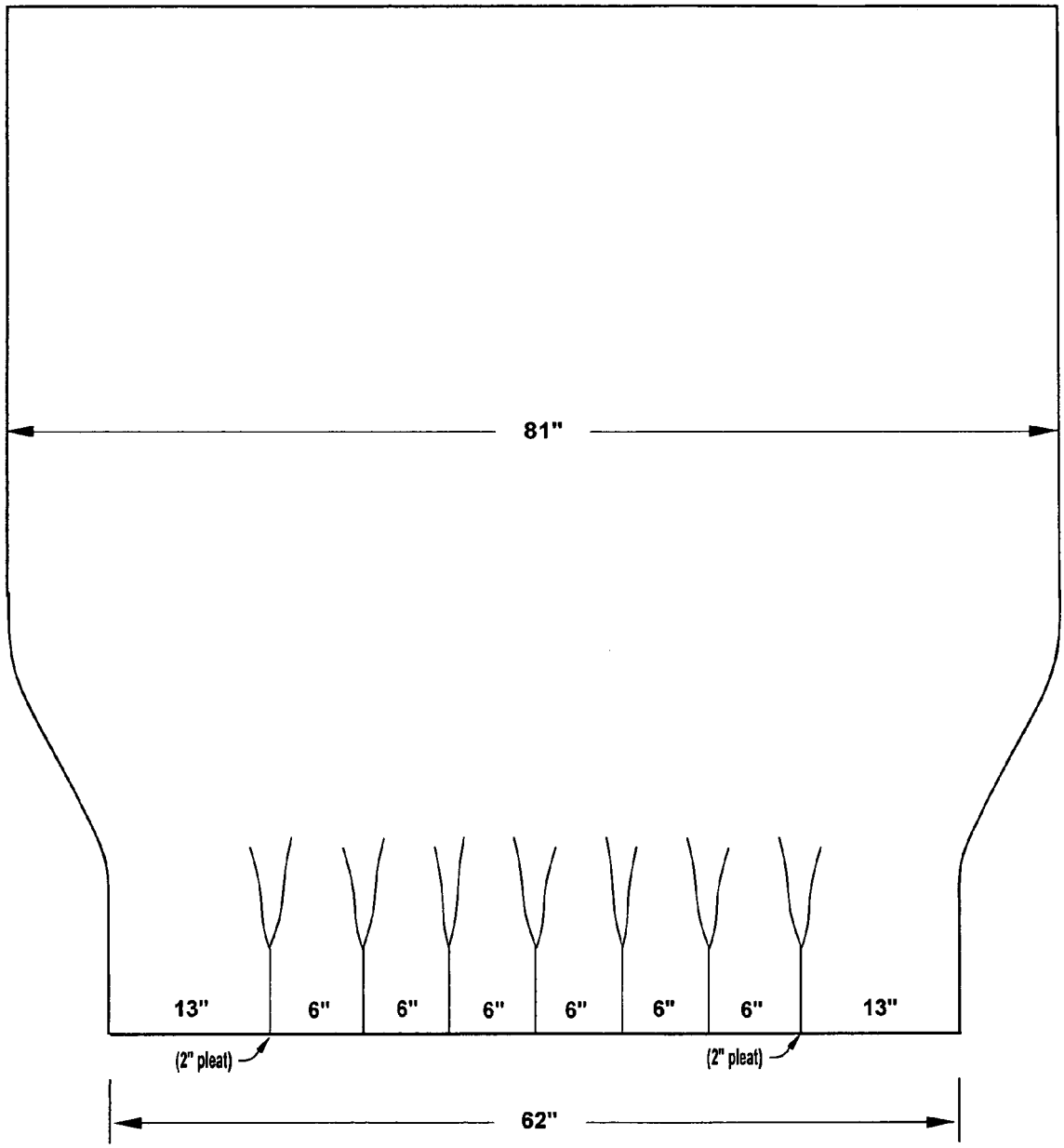
FIG. 9 is a drawing of a preferred embodiment applicable to a full or double mattress.
Figure 10:
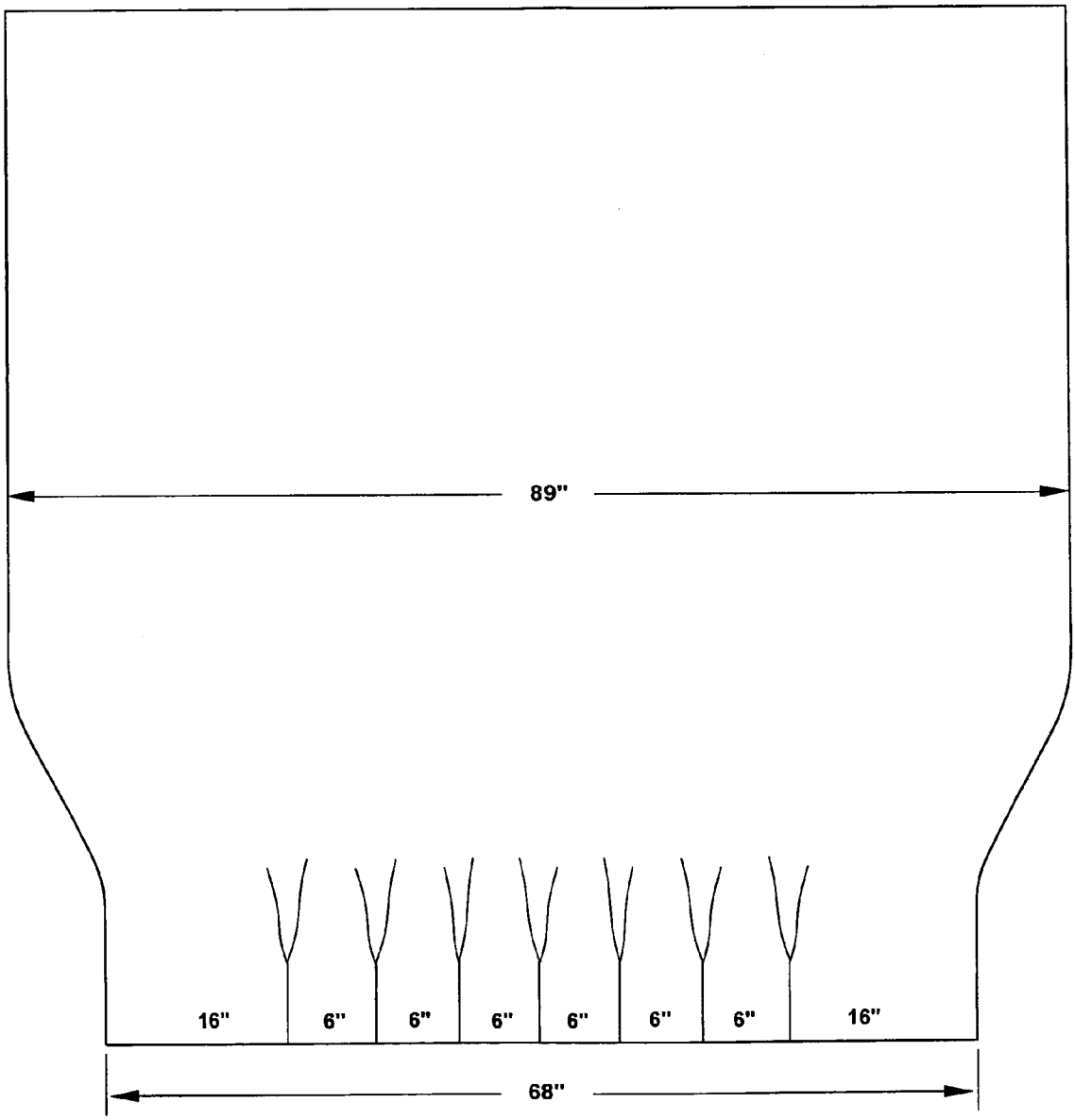
FIG. 10 is a drawing of a preferred embodiment applicable to a sheet for a queen-sized bed.
Figure 11:
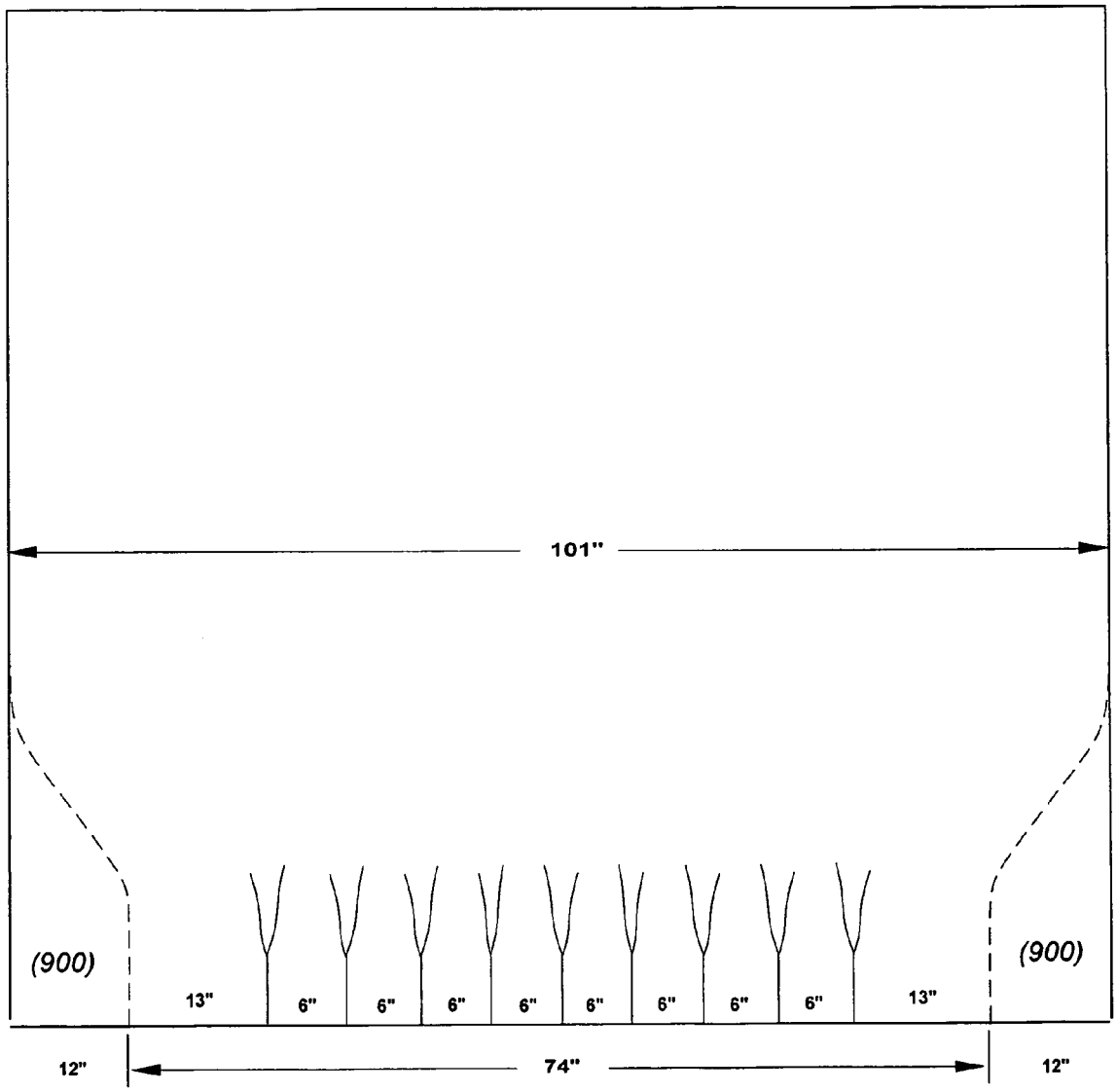
FIG. 11 is a drawing of a preferred embodiment applicable to a sheet for a king-sized bed.

FIGS. 9, 10 and 11, respectively, show preferred configurations for full-, queen- and kind-sized mattresses. Note that, particularly in the case of the kind-size sheet of FIG. 11, if sufficient pleats are provided, as shown, there may not be ample material for the purposes of tucking the sheet in under the mattress. Accordingly, portions 900 are preferably sewn onto the edges of the sheet as shown, and stitched in the areas indicated with the broken lines. With such a configuration, ample leg/foot room is provided for two persons while, at the same time, providing sufficient material for tucking-in. the use of additional side materials is not limited to the kind-size configuration, but may be used with any of the embodiments described herein.

I claim:

1. For use with a bed having a mattress with a head section, a foot section, a width and a thickness, a top sheet affording enhanced leg and foot room, comprising:

a flexible sheet of material having a width with a centerline corresponding to the width of the mattress and two sides that extend beyond the width of the mattress, a length with a top edge and a bottom edge; and at least three pleats of overlapping material extending up from the bottom edge of the flexible sheet, each pleat being within the width of the mattress and having a length extending beyond the thickness of the mattress plus a few inches for tucking purposes, the overlapping material of each pleat being stitched down from the bottom edge of the sheet to the top of the mattress, such that when the bed is made, the material puffs out around the foot section, thereby providing additional space for the legs and feet of a user.

2. The top sheet of claim 1, including a pleat generally parallel to the centerline.

3. The top sheet of claim 1, including a pleat at or near the centerline.

4. The top sheet of claim 1, wherein the pleats are box pleats.

5. The top sheet of claim 1, wherein each pleat has a length in the range of 6 to 24 inches.

6. The top sheet of claim 1, wherein each pleat has a width in the range of 1 to 6 inches.

7. The top sheet of claim 1, wherein the material is woven or non-woven cotton, satin, silk, linen, polyester, microfiber, or some combination thereof.

8. The top sheet of claim 1, including a plurality of spaced-apart pleats.

9. The top sheet of claim 1, including a plurality of spaced-apart pleats, with at least some of the spacings being greater that the width of the pleats.

* * * * *